United States Patent [19]

Zahring

[11] 3,954,350

[45] May 4, 1976

[54] ROTOR HAVING MEANS FOR LOCKING ROTOR BLADES TO ROTOR DISK

[75] Inventor: Gerhard Zahring, Munich, Germany

[73] Assignee: Motoren-und Turbinen-Union Munchen GmbH, Germany

[22] Filed: June 5, 1975

[21] Appl. No.: 584,095

[30] Foreign Application Priority Data

June 14, 1974 Germany ..... 2428775

[52] U.S. Cl. ..... 416/215

[51] Int. Cl.[2] ..... F01D 5/32

[58] Field of Search ..... 416/216–218, 215, 244 A

[56] References Cited

UNITED STATES PATENTS

| | | | |
|---|---|---|---|
| 3,053,504 | 9/1962 | Shelly | 416/215 |
| 3,088,708 | 5/1963 | Feinberg | 416/215 |
| 3,216,700 | 11/1965 | Bostock | 416/216 |
| 3,383,094 | 5/1968 | Diggs | 416/215 |
| 3,567,337 | 3/1971 | Zerlauth et al. | 416/215 X |

FOREIGN PATENTS OR APPLICATIONS

| | | | |
|---|---|---|---|
| 812,337 | 8/1951 | Germany | 416/215 |
| 659,592 | 10/1951 | United Kingdom | 416/215 |

*Primary Examiner*—Everette A. Powell, Jr.
*Attorney, Agent, or Firm*—Alan H. Levine

[57] ABSTRACT

A rotor including a circumferential groove in which blade roots are retained. A locking means between two of the blades includes a part in the groove engaging the groove walls, and a retaining element movable radially of the rotor disk as well as rotatable about an axis lying along a radius of the disk. Tabs projecting radially outwardly from the retaining element are accommodated by a slot between the platforms of two rotor blades, when the retaining element is in one angular position. When the retaining element is rotated to another angular position, the tabs are held beneath the platforms of the two adjacent blades, and the inner end of the retaining element enters a recess in the bottom of the circumferential groove. Retaining slots may be provided in the bottom surfaces of the platforms for accommodating the tabs, and a spring may be provided to urge the retaining element radially outwardly.

4 Claims, 2 Drawing Figures

ROTOR HAVING MEANS FOR LOCKING ROTOR BLADES TO ROTOR DISK

Figure 1:
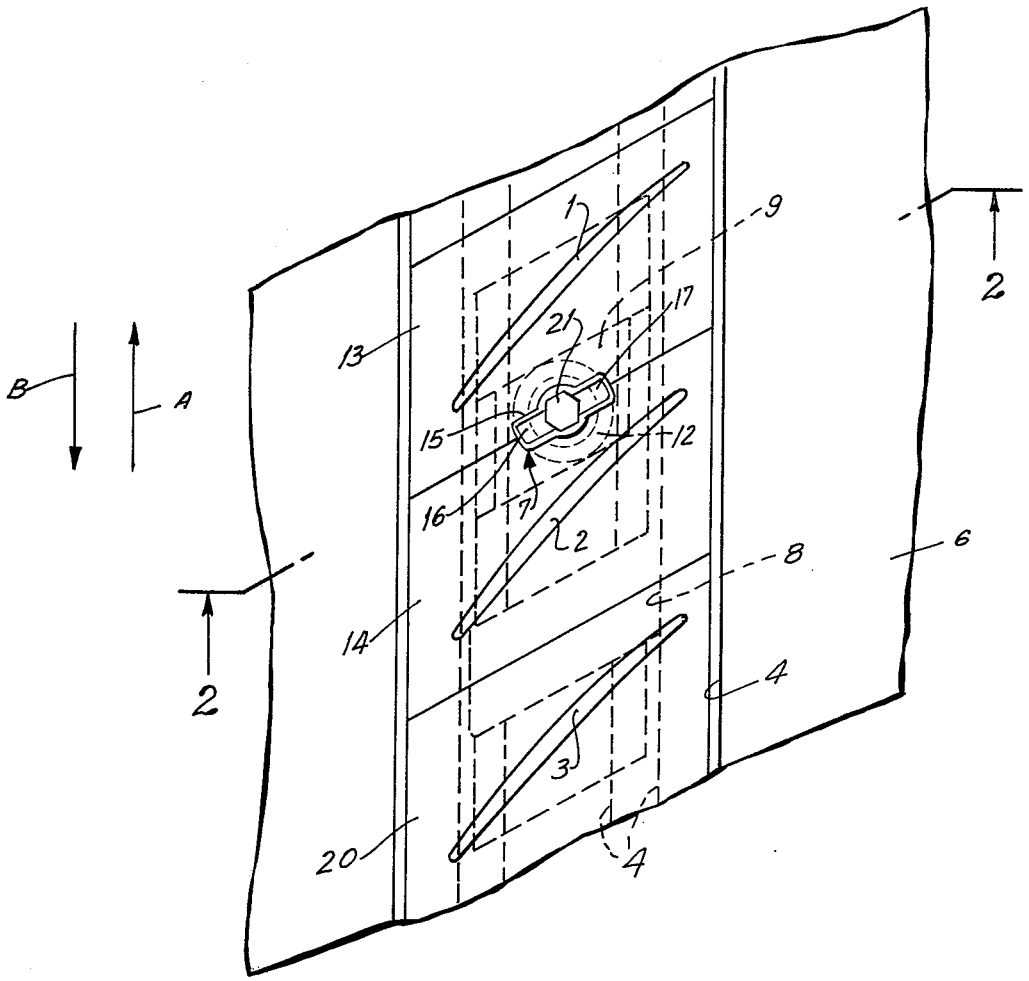

The present invention relates to means for locking the rotor blades of fluid flow machines such as turbines. In such machines, the roots of the rotor blades are inserted radially through at least one loading opening into a circumferentially extending groove in the rim of a rotor disk, and a component also inserted into the circumferential slot through the loading opening and radially supported by a helical spring is provided to fix the rotor blades against circumferential movement with respect to the rotor disk. In such an arrangement, the blade platforms may be allowed to cover the circumferential groove and form a smooth disk rim surface between themselves and the adjacent edges of a rotor disk rim.

In order to lock the rotor blades of fluid flow machines against circumferential movement along the rims of rotor disks, a known practice is to provide each rim with at least one loading opening for the rotor blades which, after the rotor blades have been firmly assembly by moving them together in the circumferential groove, is then closed off using a terminal member. Such a terminal member is in practice often made in several pieces for use with blades having different pitches and depending upon the specific type of attachment (slotted form, blade root platform configuration) normally selected for fluid flow machines. For assembly, the multipiece terminal member is then riveted or frictionally connected to the wheel rim.

In mass production, this known procedure has proved to be uneconomical in terms of time and cost, and the cost of replacement of blades during maintenance work on the fluid flow machines after manufacture has likewise been rather substantial.

A further disadvantage of the known method of locking the blades and of closing the blade loading opening has been that the terminal member on the disk rim is of relatively large size. This fact may cause not only imbalance phenomena of the rotor disk or rotor of the fluid flow machine, but may also cause critical weakening of the material of the rim in the area of the loading opening.

It is a general object of the present invention to eliminate the disadvantages described above in the state of the art, and to provide a locking means for locking the rotor blades which, considering the relatively high speeds of a fluid flow machine, nevertheless ensures great security of the rotor blades especially in the circumferential direction. The locking means for the rotor blades is also relatively easy to install and remove, and permits ready installation and removal of the blades.

The blade locking means of this invention, although simple in design, further ensures proper radial and axial support, or retention, especially of the rotor blades arranged above or near the loading opening. The blade locking means of this invention further largely avoids critical weakening of the rim material, because the loading opening, and its locking member, can be made relatively small.

It is a particular object of the present invention to provide locking means of the type described characterized by the following features in combination:

a. The locking means is provided with a centrally-located retaining dowel projecting upwardly from it, the dowel being movable circumferentially of the disk rim and displaceable toward the center of the rotor disk against the restoring force of a helical spring which surrounds the dowel;

b. The platforms of at least two blades are formed to define a slot between their abutting edges for engagement with two tabs arranged on the retaining dowel; and c. Near the loading opening the circumferential groove has a recess in its bottom surface in which the lower end of the retaining dowel can be accommodated after it has first been depressed against the force of the helical spring and its tabs have engaged, by rotating the dowel through about 90°C, in slots formed in the lower surfaces of the blade platforms of the two blades between which the locking means is located.

The present invention is an improvement over the rotor blade locking means shown in British Pat. No. 903,176. In the arrangement of that patent, the blade locking element is depressed against a helical spring for insertion into the circumferential groove through a loading opening. The locking element can spring back into the blade loading opening between the last and next-to-last rotor blades which are installed, and to an extent which prevents its displacement circumferentially between the laterally projecting shoulders of the slot.

The essential advantage provided by the present invention, over that of the British patent, is that it ensures, with relatively small over-all dimensions of the locking means, superior locking to prevent circumferential displacement of the blade with respect to the rotor disk.

In the present arrangement, the major locking effect is provided by the dowel engaging in the recess in the bottom circumferential groove, while another part of the locking means, springloaded and pressed against the groove bottom, constitutes an additional locking means against movement of the blades circumferentially.

The invention further ensures safe retention and proper radial support of the locking means between the two last-to-be-installed blades due to the engagement of the retaining dowel tabs with the slots in the bottoms of blade platforms.

A further advantage of the locking means of this invention over the prior art is that it can readily be moved within the circumferential groove, to the operating position of the locking means, after the dowel is first depressed against the force of the preloaded helical spring.

Further objects and advantages of the present invention will be seen from the following description in which reference is made to the accompanying drawings.

Figure 2:
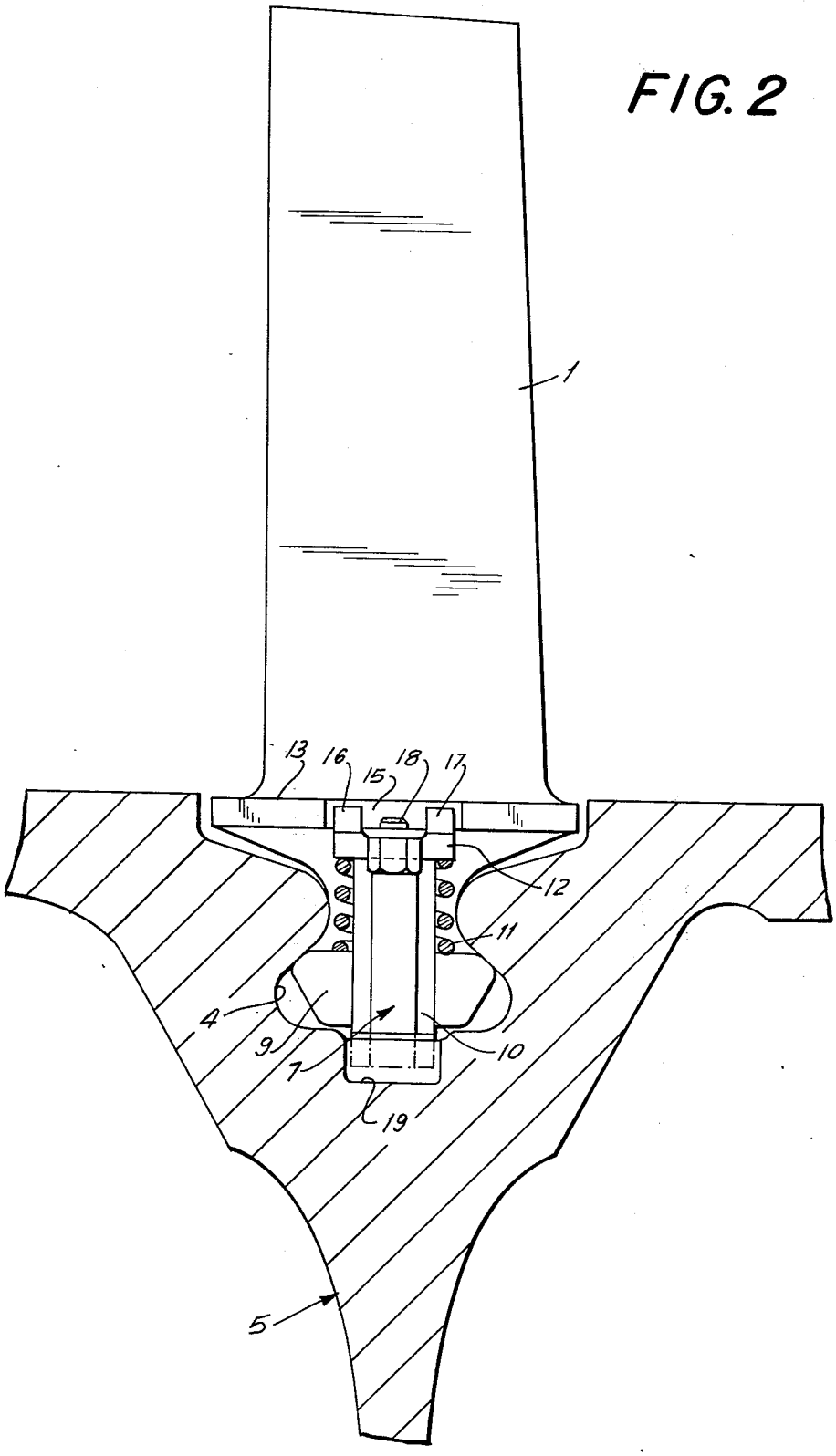

In the drawings:

FIG. 1 is a top view of a portion of a rotor disk rim fitted with blades and the locking means of this invention, and FIG. 2 is a sectional view taken along line 2—2 of FIG. 1.

In FIG. 1, the next-to-last one of the rotor blades which is installed is indicated by the numeral 1, the last of the rotor blades installed by the numeral 2, and one of the other previously-installed blades by the numeral 3. Referring to FIGS. 1 and 2, arranged between the blades 1 and 2 is the rotor blade locking means 7 within the circumferentially extending groove 4 in the rim 6 of a rotor disk 5. The loading opening through which the roots of the rotor blades 1–3 and the blade locking means 7 are inserted into the circumferential groove 4, is indicated by the numeral 8.

The blade locking element 7 (FIG. 2) comprises a part 9 shaped approximately like the contour of the blade root and is provided with a retaining dowel 10 which projects upwardly from the center of part 9. The retaining dowel 10 is movable with respect to part 9. Specifically, it is arranged for rotation about its longitudinal axis and is displaceable longitudinally, i.e., toward and away from the center of rotor disk 5. Surrounding the retaining dowel 10 is a helical spring 11 arranged between the part 9 and a collar 12 rotatable with the retaining dowel 10.

A slot 15 is formed between the abutting platforms 13 and 14 of blades 1 and 2 for engagement with tabs 16 and 17 arranged on the upper surface of collar 12. As a result, when the blades 1 and 2 are moved circumferentially within the groove 4, the blade locking means 7 is carried along with them. The blades 1 and 2 are further provided, in the lower faces of their platforms 13 and 14 with retaining slots 18 aligned with each other and lying at approximately right angles to the slot 15.

The assembly procedure is as follows:

After the root of the next-to-last of the rotor blades has been inserted through the loading opening 8 into the circumferential groove 4, and has been moved into place in circumferential direction A, the blade locking means 7 is inserted through the loading opening 8 into the circumferential slot 4 and is likewise moved in circumferential direction A to a position against the blade 1. Thereafter the last rotor blade 2 is installed in similar fashion.

All the rotor blades, including the blades 1 and 2, are then moved in circumferential direction A until the retaining dowel 10 is situated above a recess 19 (FIG. 2) formed in the bottom surface of the circumferential groove 4. In this position, the retaining dowel 10 can be depressed, against the force of helical spring 11, into a position indicated by dot-dash lines and rotated through approximately 90° so that the tabs 16 and 17 of the retaining dowel become radially aligned with the retaining slots 18 formed in the platforms of blades 1 and 2. Upon release of dowel 10, spring 11 causes the dowel to rise and tabs 16 and 17 to enter slots 18. The retaining dowel 10 remains with its lower end in the recess 19, thereby locking all the blades in place.

For disassembly, the procedure is reversed. The blade locking means 7 is first disengaged from the platforms of blades 1 and 2, and the rotor blades are moved in circumferential direction B until the last-installed rotor blade 2 can be extracted outwardly through the loading opening 8.

As will be seen in FIG. 1, the loading opening 8 is covered by the blade platforms 14 and 20 of the rotor blades 2 and 3, respectively, when the locking means is in its operating position.

For rotating and depressing the retaining dowel 10 of the locking means 7, use can be made of, e.g., an Allen wrench inserted into a hexagonal socket 21 in the retaining dowel 10.

The invention has been shown and described in preferred form only, and by way of example, and many variations may be made in the invention which will still be comprised within its spirit. It is understood, therefore, that the invention is not limited to any specific form or embodiment except insofar as such limiations are included in the appended claims.

What is claimed is:

1. A rotor for a fluid flow machine comprising:

a. a rotor disk having a circumferential groove, the groove having a recess in its bottom wall, b. a plurality of blades spaced apart circumferentially around the disk, each blade having a platform extending laterally from it and a root depending from the platform and retained in the groove, a slot being formed between two of the platforms, and c. a locking means between two of the blades for maintaining the blades against circumferential movement with respect to the disk, said locking means including:

I. a part within the groove and engaging the walls thereof,

II. a retaining element movable with respect to said part in the radial direction of the disk, the retaining element also being rotatable about an axis lying along a radius of the disk, III. tabs projecting radially outwardly from the retaining element, the tabs being accommodated by said slot in one angular position of the retaining element, and in another angular position of the retaining element the tabs being beneath the platforms of the two blades between which the locking means is located and the radially inner end of the retaining element being in the recess in the bottom wall of the groove.

2. A rotor as defined in claim 1 including retaining slots in the bottom surfaces of the blade platforms for accommodating the tabs.

3. A rotor as defined in claim 1 including resilient means urging the retaining element radially outwardly of the rotor disk.

4. A rotor as defined in claim 1 wherein the retaining element includes a dowel and a collar carried by the radially outer end of the dowel, the tabs projecting from the outer face of the collar.

* * * * *